US011014584B2

(12) United States Patent
Wang et al.

(10) Patent No.: US 11,014,584 B2
(45) Date of Patent: May 25, 2021

(54) COUPLER TELESCOPIC APPARATUS AND COUPLER

(71) Applicant: CRRC QINGDAO SIFANG ROLLING STOCK RESEARCH INSTITUTE CO., LTD., Qingdao (CN)

(72) Inventors: Guangchao Wang, Qingdao (CN); Hui Liu, Qingdao (CN); Qianqian Tian, Qingdao (CN)

(73) Assignee: CRRC QINGDAO SIFANG ROLLING STOCK RESEARCH INSTITUTE CO., LTD. (CN), Qingdao (CN)

( * ) Notice: Subject to any disclaimer, the term of this patent is extended or adjusted under 35 U.S.C. 154(b) by 0 days.

(21) Appl. No.: 17/037,043

(22) Filed: Sep. 29, 2020

(65) Prior Publication Data

US 2021/0078616 A1 Mar. 18, 2021

Related U.S. Application Data

(63) Continuation of application No. PCT/CN2018/118557, filed on Nov. 30, 2018.

(30) Foreign Application Priority Data

Jun. 27, 2018 (CN) ..... 201810677483.7

(51) Int. Cl.
*B61G 9/20* (2006.01)

(52) U.S. Cl.
CPC ..... *B61G 9/20* (2013.01)

(58) Field of Classification Search
CPC ... B61G 9/00; B61G 9/02; B61G 9/04; B61G 9/12; B61G 9/20; B61G 11/00; B61G 11/02; B61G 11/18
See application file for complete search history.

(56) References Cited

U.S. PATENT DOCUMENTS 3,776,579 A 12/1973 Gale
4,175,667 A * 11/1979 Dillner ..... B61G 11/00 188/268

(Continued)

FOREIGN PATENT DOCUMENTS

CN 200992120 Y 12/2007
CN 102030014 A 4/2011

(Continued)

OTHER PUBLICATIONS

Search Report of the priority CN application.

(Continued)

*Primary Examiner* — Jason C Smith
(74) *Attorney, Agent, or Firm* — J.C. Patents

(57) ABSTRACT

A coupler telescopic apparatus comprises a housing and a drawbar capable of extending and retracting along the housing, the housing is sleeved outside the drawbar, a limiting block is fixed arranged on an outer side face of the drawbar, a locking ring capable of coming into contact with the limiting block is sleeved inside the housing, and the locking ring is coaxial with the housing and rotatably connected to the housing; a through groove is axially formed on an inner surface of the locking ring, and the through groove correspond to the limiting block in shape, so that the limiting block passes through the through groove when the through groove is aligned with the limiting block, and then an extension of the drawbar is locked by rotating the locking ring to block the limiting block after the extension of the drawbar is completed. The present application can reduce space occupation and has simple structure.

20 Claims, 7 Drawing Sheets

(56) References Cited

U.S. PATENT DOCUMENTS

| | | | | | |
|---|---|---|---|---|---|
| 5,465,944 | A * | 11/1995 | Page | B61G 9/16 | 267/217 |
| 5,826,735 | A * | 10/1998 | Litten | B61G 9/08 | 213/43 |
| 5,871,109 | A * | 2/1999 | Litten | B61G 9/08 | 137/514.7 |
| 2005/0056607 | A1* | 3/2005 | Scott | B61G 9/20 | 213/75 R |
| 2019/0232981 | A1* | 8/2019 | Lu | B61G 9/04 | |

FOREIGN PATENT DOCUMENTS

| | | | |
|---|---|---|---|
| CN | 102424057 | A | 4/2012 |
| CN | 202368279 | U | 8/2012 |
| CN | 106218662 | A | 12/2016 |
| CN | 106809240 | A | 6/2017 |
| CN | 207038431 | U | 2/2018 |
| CN | 108839668 | A | 11/2018 |
| DE | 2448889 | C2 | 4/2015 |

OTHER PUBLICATIONS

International Search Report.
First Office Action of the priority CN application.
Second Office Action of the priority CN application.

* cited by examiner

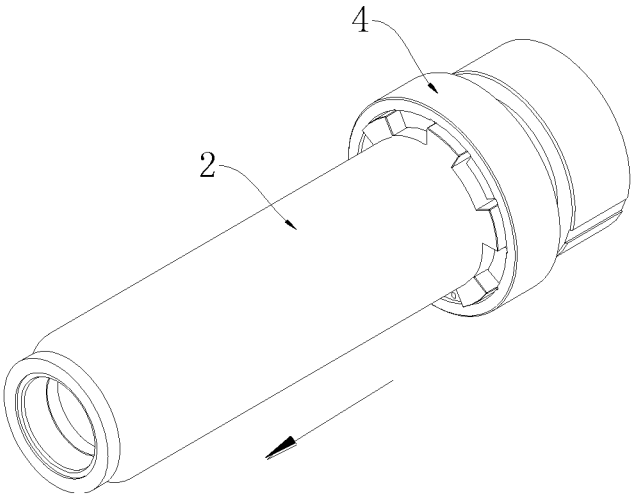
Fig. 7a
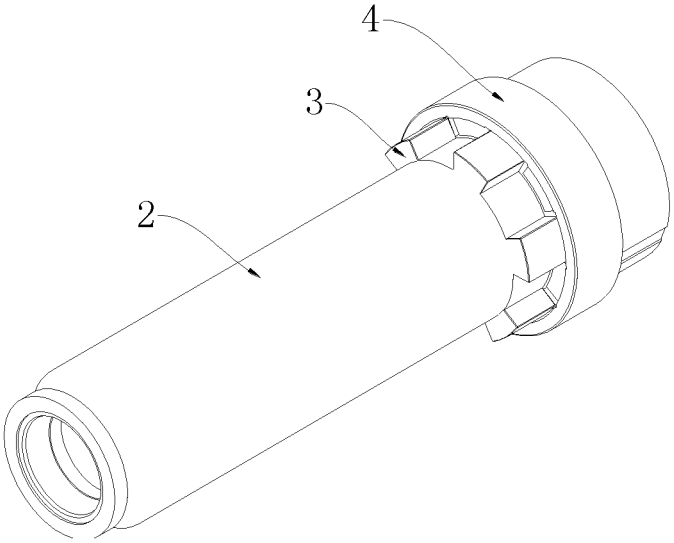
Fig. 7b
Fig. 7

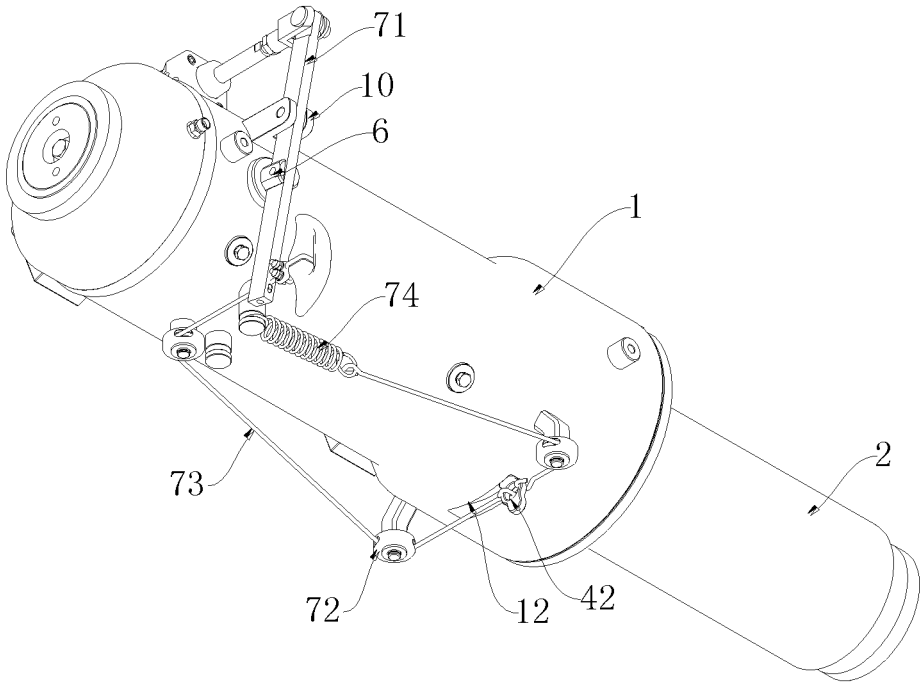
Fig. 8a
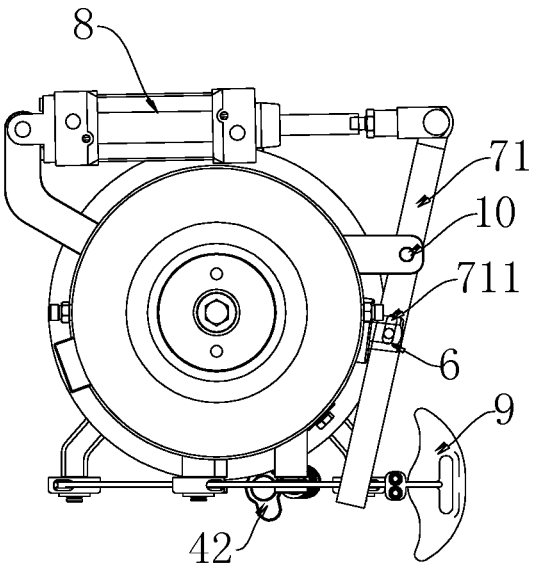
Fig. 8b
Fig. 8

COUPLER TELESCOPIC APPARATUS AND COUPLER

CROSS-REFERENCE TO RELATED APPLICATIONS

This application is a continuation of PCT/CN2018/118557 filed on Nov. 30, 2018, which claims the priority benefit of Chinese patent application No. 201810677483.7 filed on Jun. 27, 2018. The entirety of the above-mentioned patent applications is hereby incorporated by reference herein and made a part of this specification.

TECHNICAL FIELD

The present application belongs to the technical field of railway vehicles coupling, and particularly relates to a coupler telescopic apparatus and a coupler.

BACKGROUND ART

As a key component for a train coupler, a telescopic apparatus can ensure smooth completion of two actions (i.e., extending and retracting the coupler) during train operation. To enable the coupler to be kept in the current state after being extended or retracted, the telescopic apparatus is required to have a reasonable locking mechanism. Existing automatic coupler telescopic apparatus for couplers is mainly locked by the following: (1) latch, which are simple in structure but small in pressure-receiving cross-sectional area; (2) block, which are relatively simple in structure, but are easy to wear and deform at contact surfaces for a long time since the contact surfaces are two curved surfaces with different radii; and, (3) spline.

Chinese Invention Patent CN102424057A has disclosed a telescopic mechanism of a telescopic coupler buffer apparatus for a high-speed Electric Multiple Units, comprising: a pressure-receiving rod that is positioned inside a movable housing of the coupler buffer apparatus with one end connected to the movable housing, and a load-bearing joint that is sleeved on the pressure-receiving rod, wherein a guide drum is fixedly mounted outside the load-bearing joint; a telescopic diving mechanism is arranged between the guide drum and the movable housing; the end of the pressure-receiving rod is connected to the movable housing through a torsion spring, and the pressure-receiving rod and the load-bearing joint are kept in a locked state; a locking mechanism comprises bumps that are positioned at the other end of the pressure-receiving rod and distributed at intervals and grooves that are formed on an inner wall of the load-bearing joint and fitted with the bumps, with the bumps and the grooves being distributed at equal intervals, the bumps being the same in shape, and the grooves being the same in shape; when the bumps correspond to the grooves, the pressure-receiving rod and the load-bearing joint are unlocked and can slide relative to each other; an unlocking driving mechanism is arranged outside the movable housing; the unlocking driving mechanism comprises a steel wire rope that is fixedly mounted on the pressure-receiving rod and can drive the pressure-receiving rod to rotate; and, limit stops are arranged in the grooves on the load-bearing joint.

However, in the abovementioned telescopic mechanism, due to a presence of the pressure-receiving rod, the telescopic driving mechanism can only be arranged outside the housing, resulting in defects of large space occupation and complex structure.

SUMMARY

In view of the technical problems in the existing telescopic mechanisms, the present application provides a coupler telescopic apparatus which can reduce space occupation and have simple structure, and also provides a coupler using the coupler telescopic apparatus.

For this purpose, the present application employs the following technical solutions.

A coupler telescopic apparatus, comprising a housing and a drawbar capable of extending and retracting along the housing, the housing is sleeved outside the drawbar, a limiting block is fixed arranged on an outer side face of the drawbar, a locking ring capable of coming into contact with the limiting block is sleeved inside the housing, and the locking ring is coaxial with the housing and rotatably connected to the housing; a through groove is axially formed on an inner surface of the locking ring, and the through groove correspond to the limiting block in shape, so that the limiting block passes through the through groove when the through groove is aligned with the limiting block, and then an extension of the drawbar is locked by rotating the locking ring to block the limiting block after the extension of the drawbar is completed.

Preferably, there are a plurality of limiting blocks and the plurality of limiting blocks are arranged at intervals about an axis of the drawbar, and there are a plurality of through grooves corresponding to the limiting blocks.

Preferably, a telescopic cylinder is arranged in the housing, and two ends of the telescopic cylinder are connected to the housing and the drawbar, respectively, to drive the drawbar to extend or retract along the housing.

Preferably, the drawbar is sleeve-shaped, and the drawbar is sleeved outside the telescopic cylinder; a body of the telescopic cylinder is connected to the housing; the drawbar has an extension end capable of extending out from the housing, and a rod of the telescopic cylinder is connected to the extension end of the drawbar.

Preferably, a first hole is formed on a side of the housing, and a locking pin is sleeved inside the first hole; a second hole is formed on an outer side face of the drawbar; and, the second hole corresponds to the first hole, so that the second hole is aligned with the first hole and the locking pin extends into the second hole after the drawbar is retracted, so as to lock a retraction of the drawbar.

Preferably, the coupler telescopic apparatus provided by the present application further comprises a linkage assembly, the linkage assembly is connected to the locking pin to drive the locking pin to do a reciprocating motion of extending into or out from the second hole; the linkage assembly is connected to the locking ring, so as to drive the locking ring to rotate until blocking the limiting block when the locking pin extends into the second hole, and to drive the locking ring to rotate until the through groove is aligned with the limiting block when the locking pin extends out from the second hole.

Preferably, the linkage assembly comprises a rotating arm, a pulley block, a pull rope and an elastic member; the rotating arm is rotatably connected to an outer wall of the housing, and the rotating arm is connected to the locking pin to drive the locking pin to do the reciprocating motion of extending into or out from the second hole by rotating; the pulley block is fixedly arranged on the outer wall of the housing; one end of the pull rope is connected to the rotating arm, while an other end of the pull rope goes around the pulley block and is connected to the elastic member; the locking ring is fixedly connected to the pull rope to synchronously rotate with the rotating arm under a drive of the pull rope; and, the elastic member is fixedly connected to the housing to extend or contract along with a movement of the pull rope.

Preferably, an unlocking cylinder is fixedly arranged on the outer wall of the housing, and the unlocking cylinder is connected to the rotating arm to drive the rotating arm to rotate.

Preferably, an unlocking handle is fixedly connected to the rotating arm to drive the rotating arm to rotate.

A coupler is provided, comprising a telescopic apparatus, and the telescopic apparatus is the coupler telescopic apparatus described above.

Compared with the prior art, the present application has the following advantages and positive effects.

1. In the coupler telescopic apparatus provided by the present application, by fixedly arranging limiting block outside the drawbar and rotatably arranging a locking ring in the housing, when the drawbar extends out from the housing, the drawbar can be locked by only rotating the locking ring. Therefore, compared with the existing telescopic mechanisms, an internal structure of the housing is simplified, a space inside the housing is saved, and it is advantageous to arrange external driving structures in the housing and reduce space occupation.

2. In the coupler telescopic apparatus provided by the present application, by providing a locking pin, the drawbar in a retracted or extended state can be locked by the locking pin and the locking ring, respectively. The locking ring and the drawbar forms a spline-type locking mechanism used for bearing a larger force during extension locking, and the locking pin and the drawbar form a latch-type locking mechanism which is simple in structure and used for bearing a smaller force during retraction locking. Therefore, with the coupler telescopic apparatus provided by the present application, the structure is further simplified, and the efficiency of extending or retracting couplers is improved.

3. In the coupler telescopic apparatus provided by the present application, by providing a linkage assembly, the locking pin and the locking ring can be synchronously driven to move. Thus, on one hand, the number of driving elements is decreased, and the structure is further simplified; on the other hand, the control to the movement of the locking pin and the locking ring is simplified, and the efficiency of extending or retracting coupler is further improved.

BRIEF DESCRIPTION OF THE DRAWINGS

FIG. 7 (including FIGS. 7*a* and 7*b*) is a schematic diagram showing a manner in which limiting blocks and the locking ring cooperate;

FIG. 8 (including FIGS. 8*a* and 8*b*) is a schematic structure diagram of a linkage assembly 7 in a locked state.

in which:

1: housing; 11: first hole; 12: chute; 2: drawbar; 21: second hole; 3: limiting block; 4: locking ring; 41: through groove; 42: synchronous element; 5: telescopic cylinder; 51: body of the telescopic cylinder; 52: rod of the telescopic cylinder; 6: locking pin; 7: linkage assembly; 71: rotating arm; 711: long through hole; 72: pulley block; 73: pull rope; 74: elastic member; 8: unlocking cylinder; 9: unlocking handle; and, 10: hinge block.

DETAILED DESCRIPTION

The present application will be specifically described below by exemplary implementations. However, it should be understood that elements, structures and features in one implementation can be advantageously integrated into other implementations without further recitation.

In the description of the present application, it is to be noted that: (1) the fixed connection in the present application may be detachable fixed connection or integral fixed connection; (2) the orientation or position relation indicated by terms "inner", "outer", "upper", "lower", "front", "rear" or the like is an orientation or position relation shown by the accompanying drawings, merely for describing the present application and simplifying the description rather than indicating or implying that the specified apparatus or element must have a particular orientation or be constructed and operated in a particular orientation, so the terms should not be interpreted as limitations to the present application; and, (3) the terms "first" and "second" are merely descriptive, and cannot be interpreted as indicating or implying the relative importance.

A coupler telescopic apparatus provided by an embodiment of the present application comprises a housing 1 and a drawbar 2 capable of extending and retracting along the housing 1; the housing 1 is sleeved outside the drawbar 2, and the drawbar 2 is coaxial with the housing 1, the drawbar 2 is in sliding fit with the housing 1 to extend or retract along the housing 1.

Figure 1:
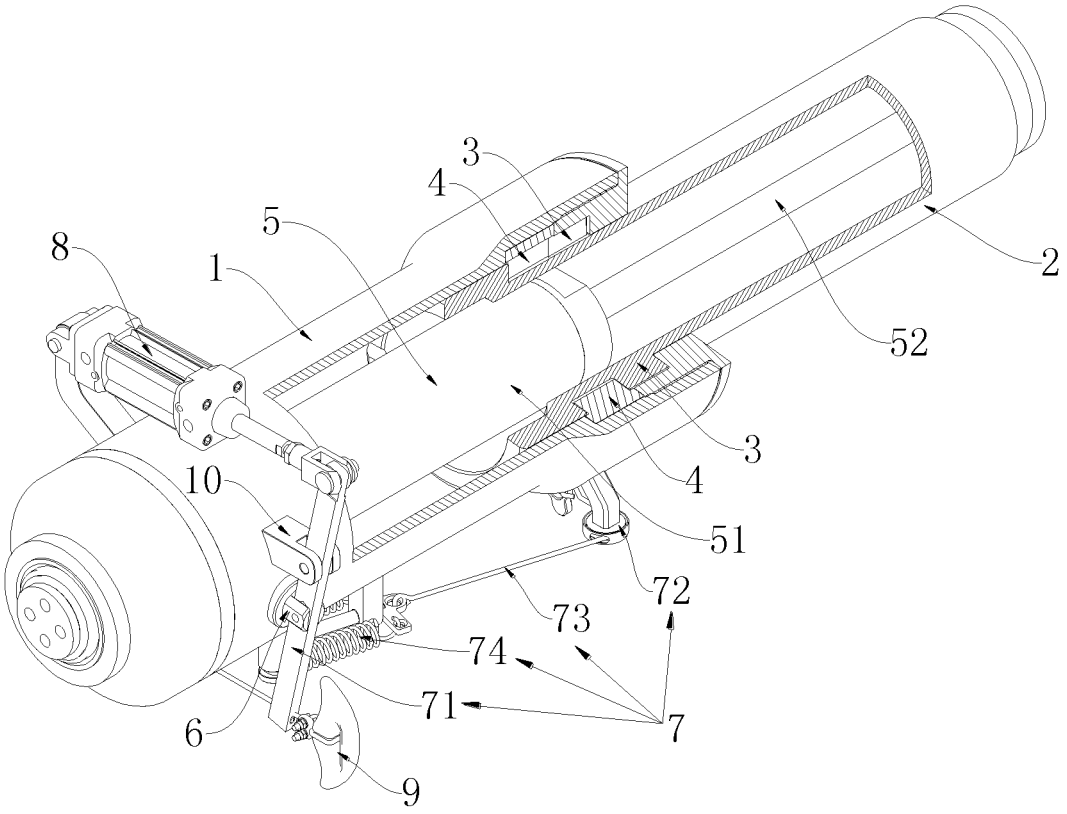
FIG. 1 is an internal structure diagram of a coupler telescopic apparatus according to an embodiment of the present application after a drawbar is extended.
Figure 2:
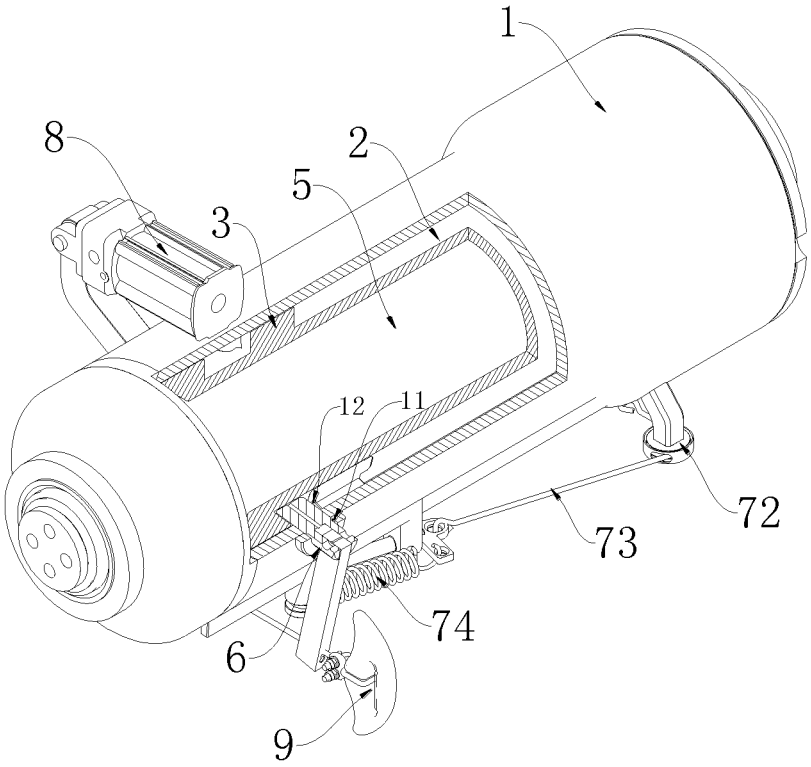
FIG. 2 is a state diagram of FIG. 1 after the drawbar is retracted.
Figure 3:
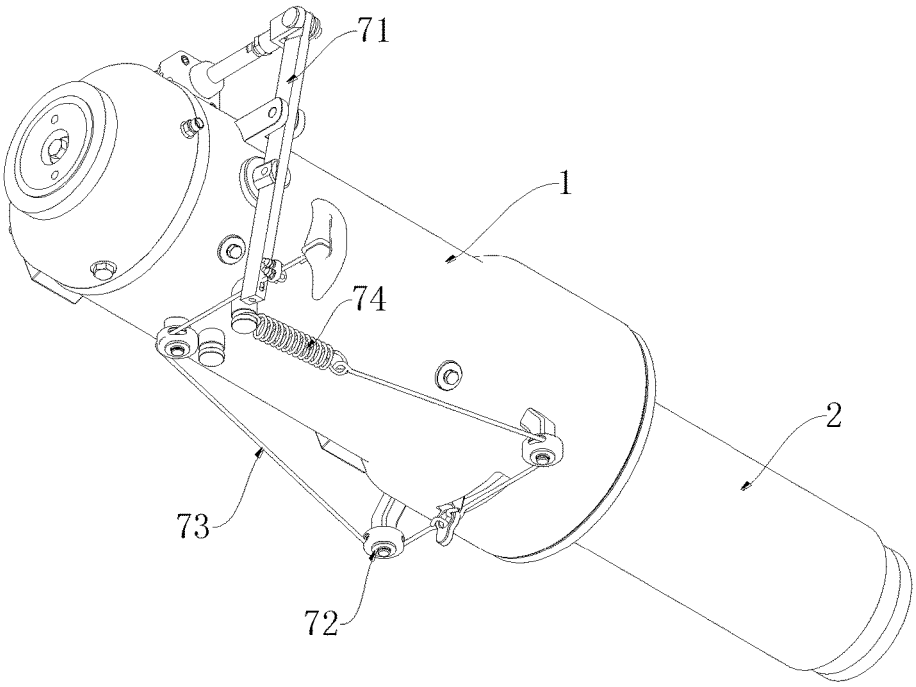
FIG. 3 is an external structure diagram of FIG. 1.
Figure 4:
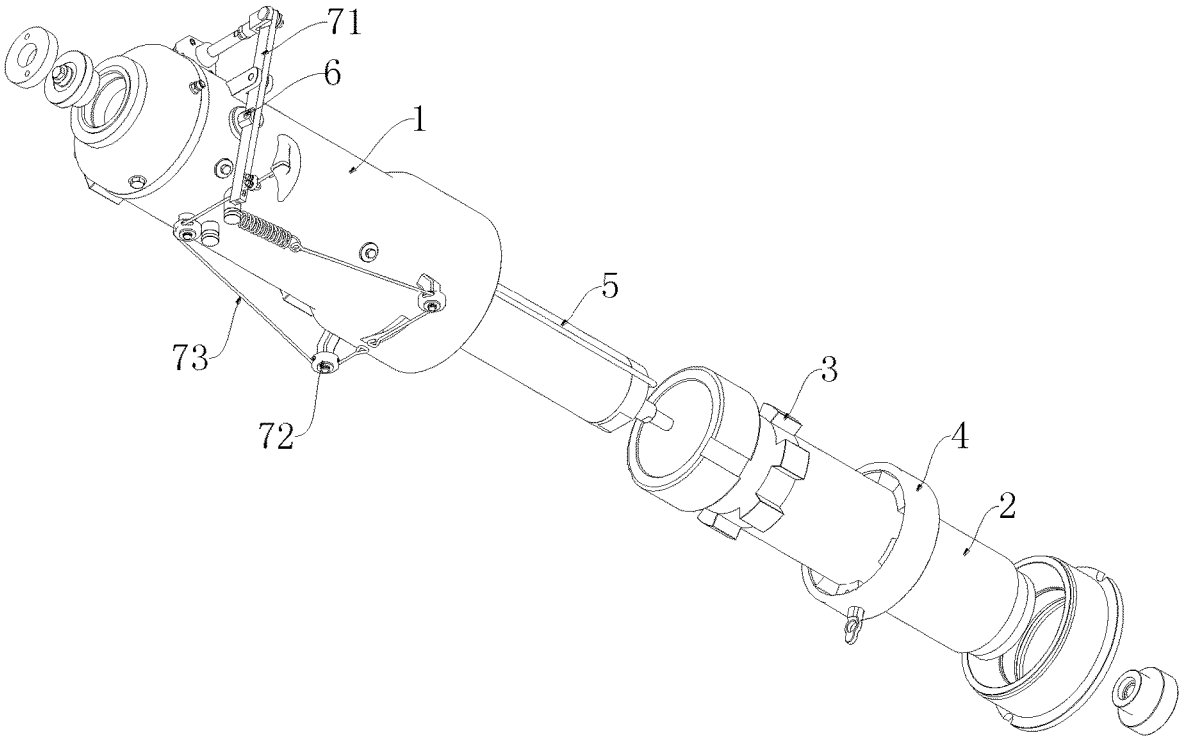
FIG. 4 is an exploded view of the coupler telescopic apparatus according to the embodiment of the present application.

FIGS. 1-3 are structure diagrams of the coupler telescopic apparatus according to the embodiment of the present application, where FIG. 1 is a schematic diagram under a state that the drawbar 2 is extended, and FIG. 2 is a schematic diagram under a state that the drawbar 2 is retracted. In FIGS. 1 and 2, a portion of the housing 1 and a portion of the drawbar 2 are removed to clearly show fitting relationships between internal components. FIG. 3 is an external structure diagram, and FIG. 4 is an exploded view of the coupler telescopic apparatus.

Figure 5:
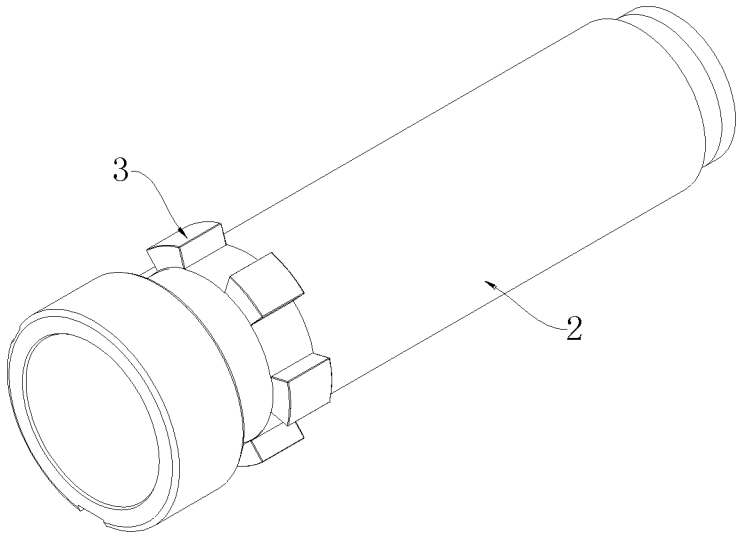
FIG. 5 is a schematic structure diagram of the drawbar according to the embodiment of the present application.

FIG. 5 shows a structure of the drawbar 2 according to the embodiment of the present application. To reduce the space occupation and simplify the structure, a limiting block 3 is fixedly arranged on an outer side face of the drawbar 2, and a locking ring 4 capable of coming into contact with the limiting block 3 is sleeved inside the housing 1. As shown in FIGS. 1 and 4, the locking ring 4 is coaxial with the housing 1 and rotatably connected to the housing 1. A structure of the locking ring is shown in FIG. 5. A through groove 41 is axially formed on an inner surface of the locking ring 4, and the through groove 41 correspond to the limiting block 3 in shape, e.g., the through groove 41 and the limiting block 3 may be connected in a key-groove fitting manner, so that the limiting block 3 passes through the through groove 41 when the through groove 41 is aligned with the limiting block 3, and then an extension of the drawbar 2 is locked by rotating the locking ring 4 to block the limiting block 3 after the extension of the drawbar is completed.

Specifically, a fitting mode of the limiting block 3 and the locking ring 4 is shown in FIGS. 7*a* and 7*b*. To clearly show the fitting relationship between the limiting block 3 and the locking ring 4, other components are omitted. In FIG. 7*a*, the limiting block 3 are aligned with the through groove 41 on the locking ring 4, the drawbar 2 extends out (moving away from the locking ring 4), and the limiting block 3 passes through the through groove 41. As shown in FIG. 7*b*, the locking ring 4 is rotated to misalign the through groove 41 with the limiting block 3, so as to limit the movement of the limiting block 3 toward the locking ring 4 and thus lock the extension of the drawbar 2. On the contrary, when the drawbar 2 is to be retracted, the locking ring 4 is rotated to align the limiting block 3 with the through groove 41, so that the drawbar 2 can be retracted into the housing 1 after passing through the through groove 41.

Based on the above, in the coupler telescopic apparatus provided by the present application, by fixedly arranging limiting block 3 outside the drawbar 2 and rotatably arranging a locking ring 4 in the housing 1, when the drawbar 2 extends out from the housing 1, the drawbar 2 can be locked by only rotating the locking ring 4. Therefore, compared with the existing telescopic mechanisms, the internal structure of the housing 1 is simplified, the space inside the housing 1 is saved, and it is advantageous to arrange external driving structures in the housing 1 and reduce space occupation.

Figure 6:
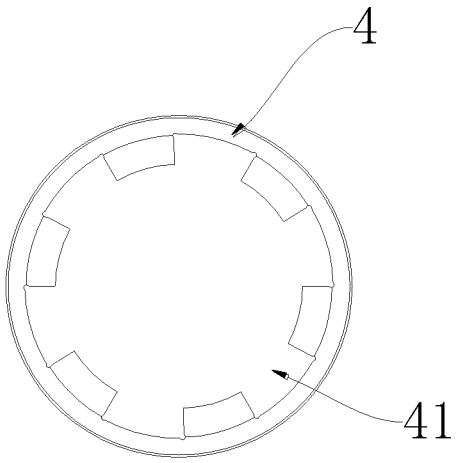
FIG. 6 is a schematic structure diagram of a locking ring according to the embodiment of the present application.

As shown in FIG. 5, to improve the stability of locking the limiting block 3 by the locking ring 4, there are preferably a plurality of limiting blocks 3 that are arranged at intervals about an axis of the drawbar 2. For example, the limiting blocks 3 are arranged about the axis of the drawbar 2 in a circular array. Correspondingly, as shown in FIG. 6, there are a plurality of through grooves 41 corresponding to the limiting blocks 3. Thus, without affecting normal extension or retraction of the drawbar 2, a contact area of the locking ring 4 with the limiting blocks can be increased, and a stability of locking the limiting blocks 3 by the locking ring 4 can be improved.

In view of a specific realization of the effect of reducing space occupation, as shown in FIGS. 1 and 2, a telescopic cylinder 5 is arranged in the housing 1, and two ends of the telescopic cylinder 5 are connected to the housing 1 and the drawbar 2, respectively, to drive the drawbar 2 to extend or retract along the housing 1.

Preferably, the drawbar 2 is sleeve-shaped, so that the drawbar 2 is sleeved outside the telescopic cylinder 5 when the drawbar 2 is retracted, with reference to FIG. 2. A body 51 of the telescopic cylinder 5 is connected to the housing 1, the drawbar 2 has an extension end capable of extending out from the housing 1, and a rod 52 of the telescopic cylinder 5 is connected to the extension end of the drawbar 2 so as to control the extension or retraction of the drawbar 2.

Specifically, further, as shown in FIGS. 1 and 2, the body 51 of the telescopic cylinder 5 is coaxial with the housing 1, and the body 51 of the telescopic cylinder 5 is connected to the housing 1 through a spherical plain bearing. Meanwhile, the rod 52 of the telescopic cylinder 5 is connected to the drawbar 2 through a spherical plain bearing, so that the telescopic cylinder 5 has a freedom of rotation, thus avoiding a damage to the telescopic cylinder 5 caused by a bending moment during extension.

To further simplify the structure, as shown in FIGS. 1-3, a first hole 11 is formed on a side of the housing 1, and a locking pin 6 is sleeved inside the first hole 11; a second hole 21 is formed on an outer side face of the drawbar 2; and, the second hole 21 corresponds to the first hole 11, so that the second hole is aligned with the first hole and the locking pin 6 extends into the second hole after the drawbar is retracted, so as to lock a retraction of the drawbar 2, as shown in FIG. 2.

Based on the above, in the coupler telescopic apparatus provided by the embodiment of the present application, by providing a locking pin 6, the drawbar 2 in a retracted or extended state can be locked by the locking pin 6 and the locking ring 4, respectively. The locking ring 4 and the drawbar 2 form a spline-type locking mechanism used for bearing a larger force during extension locking, and the locking pin 6 and the drawbar 2 form a latch-type locking mechanism which is simple in structure and used for bearing a smaller force during retraction locking. Therefore, with the coupler telescopic apparatus provided by the present application, the structure is further simplified, and the efficiency of expanding or retracting couplers is improved.

To further improve the efficiency of extending or retracting couplers, as a preferred embodiment, as shown in FIGS. 1 and 3, the coupler telescopic apparatus further comprises a linkage assembly 7, the linkage assembly 7 is connected to the locking pin 6 to drive the locking pin 6 to do a reciprocating motion of extending into or out from the second hole; the linkage assembly 7 is connected to the locking ring 4, so as to drive the locking ring 4 to rotate until blocking the limiting blocks 3 when the locking pin 6 extends into the second hole, and to drive the locking ring 4 to rotate until the through grooves are aligned with the limiting blocks 3 when the locking pin 6 extends out from the second hole.

Based on the above, in the coupler telescopic apparatus provided by the embodiment of the present application, by providing a linkage assembly 7, the locking pin 6 and the locking ring 4 can be synchronously driven to move. Thus, on one hand, a number of driving elements is decreased, and the structure is further simplified; on the other hand, a control to the movements of the locking pin 6 and the locking ring 4 is simplified, and the efficiency of extending or retracting couplers is further improved.

A structure of the linkage assembly 7 may be as following. As shown in FIGS. 1-3, the linkage assembly 7 comprises a rotating arm 71, a pulley block 72, a pull rope 73 and an elastic member 74, the rotating arm 71 is rotatably connected to an outer wall of the housing 1, and the rotating arm 71 is connected to the locking pin 6 to drive the locking pin 6 to do the reciprocating motion of extending into or out from the second hole 21 by rotating; the pulley block 72 is fixedly arranged on the outer wall of the housing 1, one end of the pull rope 73 is connected to the rotating arm 71, while an other end of the pull rope 73 goes around the pulley block and is connected to the elastic member 74; the locking ring 4 is fixedly connected to the pull rope 73 to synchronously rotate with the rotating arm 71 under a drive of the pull rope 73; the elastic member 74 is fixedly connected to the housing 1 to extend or contract along with the movement of the pull rope 73.

Specifically, further refer to FIGS. 1-3, the rotating arm 71 is preferably a lever, and a hinge block 10 is hinged at a pivot point of the rotating arm 71, and the hinge block 10 is fixedly connected to the outer wall of the housing 1, one end of the rotating arm 71 is connected to an unlocking cylinder 8 to automatically drive the rotating arm 71 to rotate.

The unlocking cylinder 8 is arranged on the outer wall of the housing 1, a body of the unlocking cylinder 8 is hinged to the housing 1, and a rod of the unlocking cylinder 8 is hinged to the rotating arm 71, and an other end of the rotating arm 71 is fixedly connected to the pull rope 73 and an unlocking handle 9. The unlocking handle 9 is used to drive the rotating arm 71 to rotate in a manual driving manner when the unlocking cylinder 8 does not operate.

A long through hole 711 is formed on a side of the pivot point of the rotating arm 71 (at a position where the rotating arm 71 is hinged to the locking pin 6) in a length direction of the rotating arm 71. The locking pin 6 has a rotating shaft, and the rotating shaft of the locking pin 6 is sleeved inside the long through hole 711 of the rotating arm 71 to do a reciprocating motion along the long through hole of the rotating arm 71 during its rotation relative to the rotating arm 71.

As shown in FIG. 3, the pulley block 72 comprises three pulleys, and the three pulleys are arranged in a triangle shape, one pulley is located on a side of the rotating arm 71, and the other two pulleys are located at a side of the locking rind 4; the pull rope 73 successively goes around the three pulleys from the rotating arm 71 to be fixedly connected to the elastic member 74. The elastic member 74 is preferably a telescopic spring, and two ends of the elastic member 74 are fixedly connected to the pull rope 73 and the housing 1, respectively.

Figure 9A:
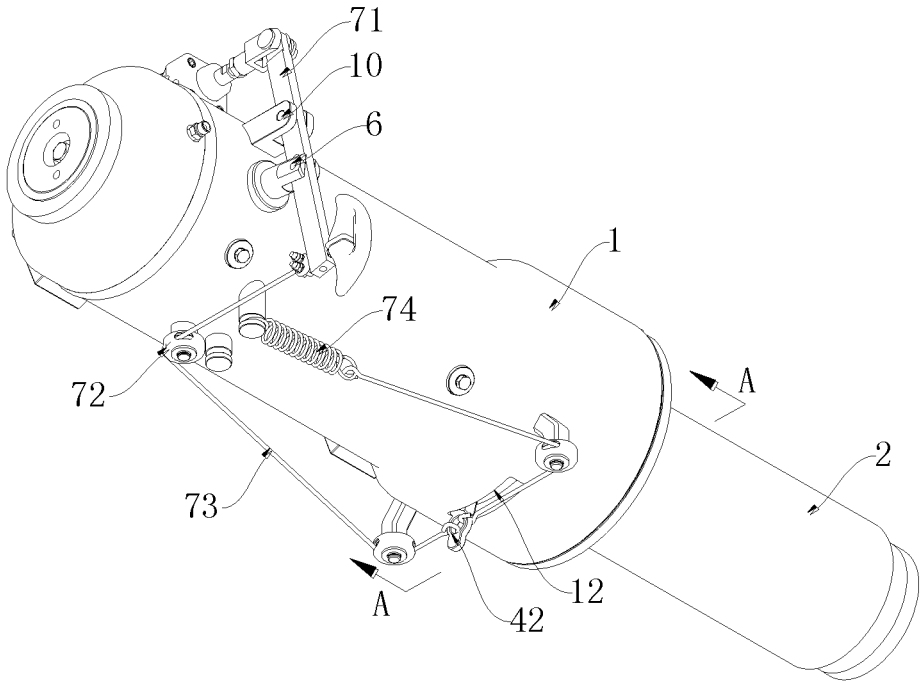
FIG. 9 (including FIGS. 9*a*, 9*b* and 9*c*) is a schematic structure diagram of the linkage assembly 7 in an unlocked state.
Figure 9B:
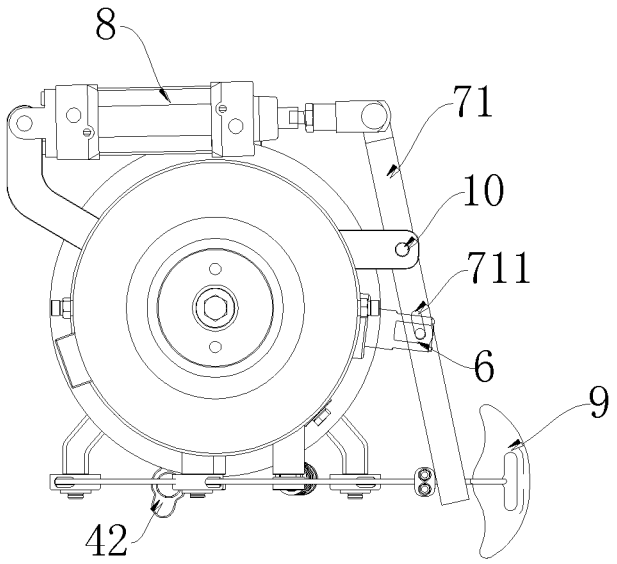
Figures 9, 9C:
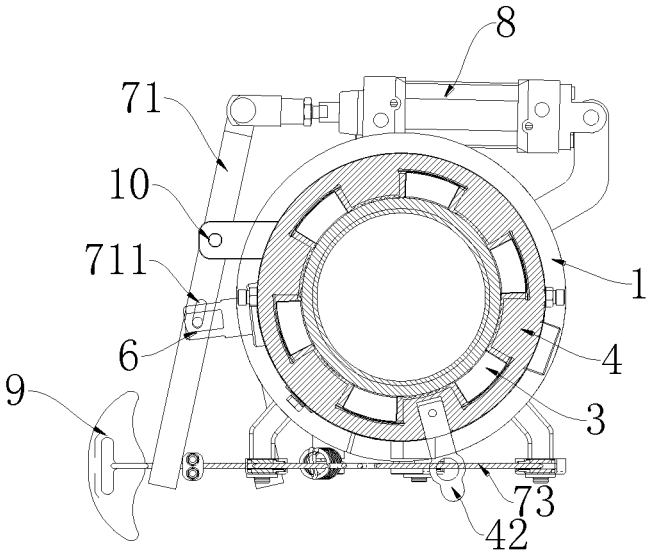

FIGS. 8*a* and 8*b* are a schematic structure diagram of the linkage assembly 7 in a locked state, where FIG. 8*a* is a stereoscopic view, and FIG. 8*b* is a left view of FIG. 8*a*. FIGS. 9*a*, 9*b* and 9*c* are a schematic structure diagram of the linkage assembly 7 in an unlocked state, where FIG. 9*a* is a stereoscopic view, FIG. 9*b* is a left view of FIG. 9*a*, and FIG. 9*c* is a sectional view along A-A.

As shown in FIGS. 8*a* and 9*a*, a chute 12 is formed on the outer wall of the housing 1 corresponding to the locking ring 4, the chute 12 runs through the housing 1 in a thickness direction of the housing 1, and the chute is arc-shaped; the locking ring 4 is fixedly connected to a synchronous element 42, and the synchronous element 42 is in sliding fit with the chute 12 to do a reciprocating motion along the chute 12; the synchronous element 42 is fixedly connected to the pull rope 73 to transfer a reciprocating motion of the pull rope 73 to the locking ring 4, so as to realize a reciprocating motion of the locking ring 4.

To explain the operating principle of the embodiment of the present application more clearly, the following detailed description will be given with reference to FIGS. 1-2 and FIGS. 8*a*, 8*b*, 9*a*, 9*b* and 9*c*.

1. Extension Locking

As shown in FIG. 2, the drawbar 2 is completely retracted. At this time, the locking pin 6 is at a locking position and forms the latch-type locking with the drawbar 2. At this time, the state of the linkage assembly 7 is shown in FIGS. 8*a* and 8*b* (however, it differs from FIGS. 8*a* and 8*b* that the drawbar 2 is in a retracted state at this time).

By retracting of the unlocking cylinder 8 or pulling the unlocking handle 9, the rotating arm 71 is driven to rotate to pull the locking pin 6 out from the drawbar 2. At this time, the state of the linkage assembly 7 changes from FIGS. 8*a* and 8*b* to FIGS. 9*a*, 9*b* and 9*c* (however, it differs from FIGS. 9*a*, 9*b* and 9*c* that the drawbar 2 has not yet extended at this time). Meanwhile, the rotating arm 71 pulls the pull rope 73, so that the synchronous element 42 moves from one side to the other side of the chute 12, and the synchronous element 42 drives the locking ring 4 to rotate to align the limiting blocks 3 with the through grooves 41. At this time, both the locking ring 4 and the locking pin 6 reach the unlocking position.

The telescopic cylinder 5 extends out to drive the drawbar 2 to extend out. During this process, the limiting blocks 3 smoothly pass through the through grooves 41 (with reference to FIGS. 7*a* and 7*b*). After the drawbar 2 is extended in place, the unlocking cylinder 8 is reset or the unlocking handle 9 is released. By the function of the elastic member 74, the locking ring 4 and the locking pin 6 are restored to the locking position, that is, the linkage assembly 7 is restored to the state shown in FIGS. 8*a* and 8*b*. The limiting blocks 3 are misaligned with the through grooves on the locking ring 4, and the drawbar 2 cannot be retracted, so that the extension locking is realized. At this time, the state of the coupler telescopic apparatus is shown in FIG. 1.

2. Retraction Locking

As shown in FIG. 1, the drawbar 2 is completely extended. At this time, the locking pin 6 is at the locking position and forms the spline-type locking with the drawbar 2. At this time, the state of the linkage assembly 7 is shown in FIGS. 8*a* and 8*b*.

By retracting of the unlocking cylinder 8 or pulling the unlocking handle 9, the rotating arm 71 is driven to rotate to pull the locking pin 6 out from the drawbar 2. At this time, the state of the linkage assembly 7 changes from FIGS. 8*a* and 8*b* to FIGS. 9*a*, 9*b* and 9*c*. Meanwhile, the rotating arm 71 pulls the pull rope 73, so that the synchronous element 42 moves from one side to the other side of the chute 12, and the synchronous element 42 drives the locking ring 4 to rotate to align the limiting blocks 3 with the through grooves 41. At this time, both the locking ring 4 and the locking pin 6 reach the unlocking position.

The telescopic cylinder 5 is retracted to drive the drawbar 2 to retract. During this process, the limiting blocks 3 smoothly pass through the through grooves 41. After the drawbar 2 is retracted in place, the unlocking cylinder 8 is reset or the unlocking handle 9 is released. By the function of the elastic member 74, the locking ring 4 and the locking pin 6 are restored to the locking position, that is, the linkage assembly 7 is restored to the state shown in FIGS. 8*a* and 8*b* (however, it differs from FIGS. 8*a* and 8*b* that the drawbar 2 is in the retracted state at this time). Then, the locking pin 6 forms the latch-type locking with the drawbar 2 again, and the drawbar 2 cannot extend out, so that the retraction locking is realized. At this time, the state of the coupler telescopic apparatus is shown in FIG. 2.

Another embodiment of the present application further provides a coupler, comprising a telescopic apparatus. A specific structure of the telescopic apparatus refers to the above embodiment. Since the coupler employs all the technical solutions in the above embodiment, the coupler at least achieves all beneficial effects brought by the technical solutions in the above embodiment, and it will not be repeated here.

The invention claimed is:

1. A coupler telescopic apparatus, comprising a housing and a drawbar capable of extending and retracting along the housing, the housing being sleeved outside the drawbar; wherein:

a limiting block is fixed arranged on an outer side face of the drawbar, a locking ring capable of coming into contact with the limiting block is sleeved inside the housing, and the locking ring is coaxial with the housing and rotatably connected to the housing;

a through groove is axially formed on an inner surface of the locking ring, and the through groove correspond to the limiting block in shape, so that the limiting block passes through the through groove when the through groove is aligned with the limiting block, and then an extension of the drawbar is locked by rotating the locking ring to block the limiting block after the extension of the drawbar is completed; and there are a plurality of limiting blocks and the plurality of limiting blocks are arranged at intervals about an axis of the drawbar, and there are a plurality of through grooves corresponding to the limiting blocks.

2. The coupler telescopic apparatus according to claim 1, wherein a telescopic cylinder is arranged in the housing, and two ends of the telescopic cylinder are connected to the housing and the drawbar, respectively, to drive the drawbar to extend or retract along the housing.

3. The coupler telescopic apparatus according to claim 2, wherein the drawbar is sleeve-shaped, and the drawbar is sleeved outside the telescopic cylinder; a body of the telescopic cylinder is connected to the housing; the drawbar has an extension end capable of extending out from the housing, and a rod of the telescopic cylinder is connected to the extension end of the drawbar.

4. The coupler telescopic apparatus according to claim 1, wherein a first hole is formed on a side of the housing, and a locking pin is sleeved inside the first hole; a second hole is formed on an outer side face of the drawbar; and, the second hole corresponds to the first hole, so that the second hole is aligned with the first hole and the locking pin extends into the second hole after the drawbar is retracted, so as to lock a retraction of the drawbar.

5. The coupler telescopic apparatus according to claim 4, wherein further comprises a linkage assembly, the linkage assembly is connected to the locking pin to drive the locking pin to do a reciprocating motion of extending into or out from the second hole; the linkage assembly is connected to the locking ring, so as to drive the locking ring to rotate until blocking the limiting block when the locking pin extends into the second hole, and to drive the locking ring to rotate until the through groove is aligned with the limiting block when the locking pin extends out from the second hole.

6. The coupler telescopic apparatus according to claim 5, wherein the linkage assembly comprises a rotating arm, a pulley block, a pull rope and an elastic member; the rotating arm is rotatably connected to an outer wall of the housing, and the rotating arm is connected to the locking pin to drive the locking pin to do the reciprocating motion of extending into or out from the second hole by rotating; the pulley block is fixedly arranged on the outer wall of the housing; one end of the pull rope is connected to the rotating arm, while an other end of the pull rope goes around the pulley block and is connected to the elastic member; the locking ring is fixedly connected to the pull rope to synchronously rotate with the rotating arm under a drive of the pull rope; and, the elastic member is fixedly connected to the housing to extend or contract along with a movement of the pull rope.

7. The coupler telescopic apparatus according to claim 6, wherein an unlocking handle is fixedly connected to the rotating arm to drive the rotating arm to rotate.

8. The coupler telescopic apparatus according to claim 6, wherein an unlocking cylinder is fixedly arranged on the outer wall of the housing, and the unlocking cylinder is connected to the rotating arm to drive the rotating arm to rotate.

9. The coupler telescopic apparatus according to claim 8, wherein an unlocking handle is fixedly connected to the rotating arm to drive the rotating arm to rotate.

10. A coupler, comprising the coupler telescopic apparatus according to claim 1.

11. A coupler telescopic apparatus, comprising a housing and a drawbar capable of extending and retracting along the housing, the housing being sleeved outside the drawbar;

wherein:

a limiting block is fixed arranged on an outer side face of the drawbar, a locking ring capable of coming into contact with the limiting block is sleeved inside the housing, and the locking ring is coaxial with the housing and rotatably connected to the housing;

a through groove is axially formed on an inner surface of the locking ring, and the through groove correspond to the limiting block in shape, so that the limiting block passes through the through groove when the through groove is aligned with the limiting block, and then an extension of the drawbar is locked by rotating the locking ring to block the limiting block after the extension of the drawbar is completed; and a telescopic cylinder is arranged in the housing, and two ends of the telescopic cylinder are connected to the housing and the drawbar, respectively, to drive the drawbar to extend or retract along the housing.

12. The coupler telescopic apparatus according to claim 11, wherein the drawbar is sleeve-shaped, and the drawbar is sleeved outside the telescopic cylinder; a body of the telescopic cylinder is connected to the housing; the drawbar has an extension end capable of extending out from the housing, and a rod of the telescopic cylinder is connected to the extension end of the drawbar.

13. A coupler, comprising the coupler telescopic apparatus according to claim 11.

14. A coupler telescopic apparatus, comprising a housing and a drawbar capable of extending and retracting along the housing, the housing being sleeved outside the drawbar; wherein:

a limiting block is fixed arranged on an outer side face of the drawbar, a locking ring capable of coming into contact with the limiting block is sleeved inside the housing, and the locking ring is coaxial with the housing and rotatably connected to the housing;

a through groove is axially formed on an inner surface of the locking ring, and the through groove correspond to the limiting block in shape, so that the limiting block passes through the through groove when the through groove is aligned with the limiting block, and then an extension of the drawbar is locked by rotating the locking ring to block the limiting block after the extension of the drawbar is completed; and a first hole is formed on a side of the housing, and a locking pin is sleeved inside the first hole; a second hole is formed on an outer side face of the drawbar; and, the second hole corresponds to the first hole, so that the second hole is aligned with the first hole and the locking pin extends into the second hole after the drawbar is retracted, so as to lock a retraction of the drawbar.

15. The coupler telescopic apparatus according to claim 14, wherein further comprises a linkage assembly, the linkage assembly is connected to the locking pin to drive the locking pin to do a reciprocating motion of extending into or out from the second hole; the linkage assembly is connected to the locking ring, so as to drive the locking ring to rotate until blocking the limiting block when the locking pin extends into the second hole, and to drive the locking ring to rotate until the through groove is aligned with the limiting block when the locking pin extends out from the second hole.

16. The coupler telescopic apparatus according to claim 15, wherein the linkage assembly comprises a rotating arm, a pulley block, a pull rope and an elastic member; the rotating arm is rotatably connected to an outer wall of the housing, and the rotating arm is connected to the locking pin to drive the locking pin to do the reciprocating motion of extending into or out from the second hole by rotating; the pulley block is fixedly arranged on the outer wall of the housing; one end of the pull rope is connected to the rotating arm, while an other end of the pull rope goes around the pulley block and is connected to the elastic member; the locking ring is fixedly connected to the pull rope to synchronously rotate with the rotating arm under a drive of the pull rope; and, the elastic member is fixedly connected to the housing to extend or contract along with a movement of the pull rope.

17. The coupler telescopic apparatus according to claim 16, wherein an unlocking cylinder is fixedly arranged on the outer wall of the housing, and the unlocking cylinder is connected to the rotating arm to drive the rotating arm to rotate.

18. The coupler telescopic apparatus according to claim 17, wherein an unlocking handle is fixedly connected to the rotating arm to drive the rotating arm to rotate.

19. The coupler telescopic apparatus according to claim 16, wherein an unlocking handle is fixedly connected to the rotating arm to drive the rotating arm to rotate.

20. A coupler, comprising the coupler telescopic apparatus according to claim 14.

* * * * *